US006056563A

United States Patent [19]

Betzler

[11] Patent Number: 6,056,563

[45] Date of Patent: May 2, 2000

[54] ELECTRICAL CORD LOCK

[76] Inventor: John R. Betzler, 1375 Mainsail Dr., Naples, Fla. 34114

[21] Appl. No.: 08/808,909

[22] Filed: Mar. 3, 1997

[51] Int. Cl.[7] ..... H01R 13/44

[52] U.S. Cl. ..... 439/134; 439/133

[58] Field of Search ..... 439/134, 133, 439/135, 147; 174/67; 200/43.22

[56] References Cited

U.S. PATENT DOCUMENTS

| | | | |
|---|---|---|---|
| 2,643,787 | 6/1953 | Rockman | 439/133 |
| 4,479,688 | 10/1984 | Jennings | 439/133 |
| 4,488,764 | 12/1984 | Pfenning et al. | 439/133 |
| 4,653,824 | 3/1987 | Jason et al. | 439/134 |
| 4,669,281 | 6/1987 | Young | 439/133 |
| 4,679,873 | 7/1987 | Brackett, Jr. | 439/134 |
| 5,073,122 | 12/1991 | Burke, Jr. | 439/134 |
| 5,186,636 | 2/1993 | Boyer et al. | 439/134 |
| 5,393,237 | 2/1995 | Roy et al. | 439/134 |
| 5,431,572 | 7/1995 | Surrey et al. | 439/134 |

FOREIGN PATENT DOCUMENTS

| | | | |
|---|---|---|---|
| 004142786 | 6/1993 | Germany | 439/133 |

*Primary Examiner*—Paula Bradley
*Assistant Examiner*—Tho D. Ta

[57] ABSTRACT

An electrical-cord lock has a plug container (1) that is sized and shaped to receive an electrical-cord plug (2) laterally. The plug container has first and second ends (3, 4) that are closed and a closure wall (5) that is operable and closeable with a wall positioner such as a tongue-and-grooved slide-way (8, 9). The first end of the plug container has a cord bay (6) that is sized and shaped to receive an electrical cord (7) laterally and to prevent passage of the cord plug through the cord bay. The wall positioner positions the closure wall selectively to open and to close the cord bay and the plug container. A closure lock (12, 18) locks the closure wall in closed position at an entrance to the cord bay and at an entrance to the plug container, such that the cord plug can be locked into and unlocked from the plug container with the closure lock on the closure wall.

13 Claims, 3 Drawing Sheets

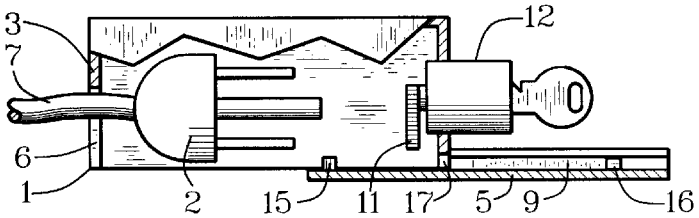
FIG. 20
FIG. 21
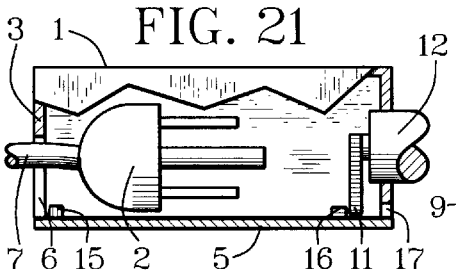
FIG. 22
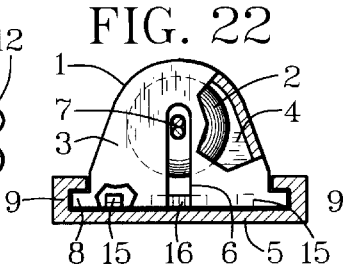
FIG. 23
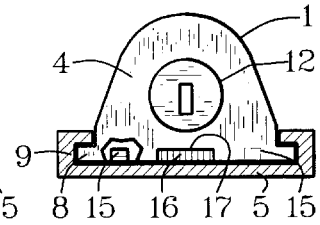
FIG. 24
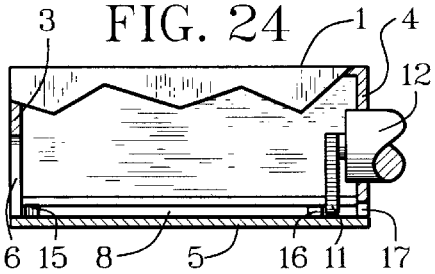
FIG. 25
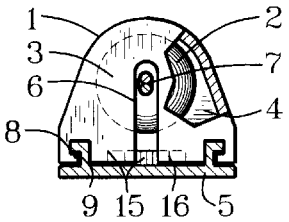
FIG. 26
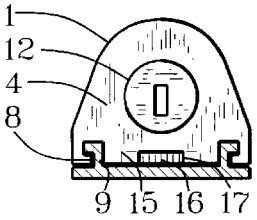
FIG. 27
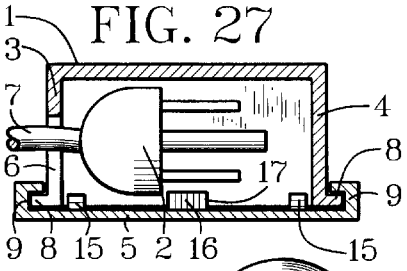
FIG. 28
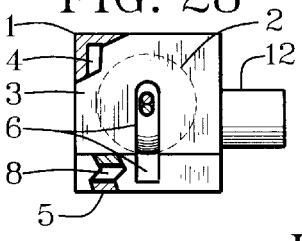
FIG. 29
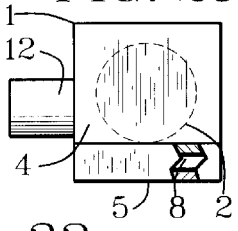
FIG. 30
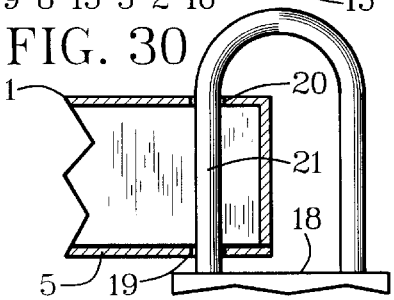
FIG. 31
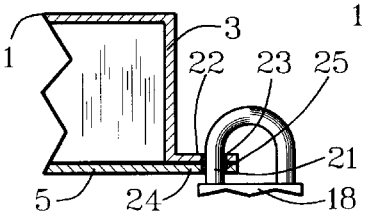
FIG. 32
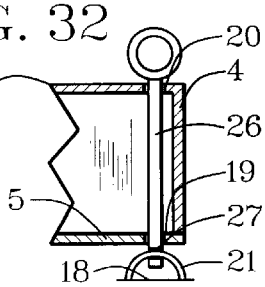

ELECTRICAL CORD LOCK

BACKGROUND OF THE INVENTION

1. Field of the Invention

This invention relates to locks on electrical cords of television sets and other electrical items to prevent their unauthorized use.

2. Relation To Prior Art

Previous locks for electrical cords are known but do not provide the convenience of use, versatility and adaptability to aesthetic structure and design provided by this invention.

Different but related locks for plugs on electrical cords are described in the following patent documents. U.S. Pat. No. 5,431,572, issued to Surrey at al, taught a plug-lock box that was limited to a sliding door having an edge aperture for receiving electrical cord. U.S. Pat. No. 5,186,636, issued to Boyer et al, described a hollow body for receiving a cord plug and matching apertures for receiving shackles or a "hasp" of a padlock for holding on a lid with a cord aperture. U.S. Pat. No. 5,073,122, issued to Burke, Jr., was limited to a lock-out enclosure comprising a cylindrical tube for receiving a cord plug and having a cylindrical flange on an end cap with a means for permanently locking the cylindrical flange to one end of the cylindrical tube. U.S. Pat. No. 4,679,873, issued to Brackett, Jr., taught a plug lock having a housing with a first end closed and a second end having a closure with a tongue extended through the first end and a means for locking the tongue to the first end to prevent removal of the second end. U.S. Pat. No. 4,653,824, issued to Jason et al, taught a plug lock-out device having an open-ended housing with an opening at one end large enough to receive a cord plug, a central divider for receiving circuit prongs of the plug and a lock means for preventing exit of the plug from the open-ended housing.

SUMMARY OF THE INVENTION

In light of need for improvement of cord locks for preventing unauthorized use of television sets and other electrical items, objects of this invention are to provide an electrical-cord lock which:

Can be locked onto an electrical cord conveniently;

Prevents insertion of the electrical cord into an electrical socket in order to prevent unauthorized use of an electrical item such as a television set or machine from which the electrical cord is extended;

Can not be pried open by intended unauthorized users;

Can be opened easily when desired; and

Is adaptable to a selection of aesthetic designs,

This invention accomplishes these and other objectives with an electrical-cord lock having a plug container that is sized and shaped to receive a cord plug laterally. The plug container has first and second ends that are closed and a closure wall that is openable and closeable with a wall positioner. The first end of the plug container has a cord bay that is sized and shaped to receive an electrical cord laterally and to prevent passage of the cord plug through the cord bay. The wall positioner positions the closure wall selectively to open and to close the cord bay and the plug container. A closure lock locks the closure wall in closed position at an entrance to the cord bay and at an entrance to the plug container, such that the cord plug can be locked into and unlocked from the plug container with the closure lock on the closure wall.

BRIEF DESCRIPTION OF DRAWINGS

This invention is described by appended claims in relation to description of a preferred embodiment with reference to the following drawings which are described briefly as follows:

FIG. 20 is a partially cutaway side view with a closure wall that slides from a second end on a slideway with slideway tongues that extend outwardly from oppositely disposed linear edges of a plug container having a design cross section;

FIG. 21 is the FIG. 20 illustration in a locked mode;

FIG. 22 is a partially cutaway first-end view with a closure wall that slides from a second end on a slideway with slideway tongues that extend outwardly from oppositely disposed linear edges of a plug container having a design cross section;

FIG. 23 is a partially cutaway second-end view of the FIG. 22 illustration;

FIG. 24 is a partially cutaway side view with a closure wall that slides from a second end of a plug container on a slideway with slideway tongues that extend inwardly from oppositely disposed linear edges of a plug container having a design cross section;

FIG. 25 is a partially cutaway first-end view with a closure wall that slides from a second end of a plug container on a slideway with slideway tongues that extend inwardly from oppositely disposed linear edges of a plug container having a design cross section;

FIG. 26 is a partially cutaway second-end view of the FIG. 25 illustration;

FIG. 27 is a partially cutaway side view with a closure wall that slides from a design side of a plug container on a slideway with slideway tongues that extend outwardly from oppositely disposed side edges of a plug container having a design cross section;

FIG. 28 is a partially cutaway first-end view of the FIG. 27 illustration;

FIG. 29 is a second-end view of the FIG. 28 illustration;

FIG. 30 is a partially cutaway sectional side view of padlock shackles in shackle orifices positioned in the plug container and in the closure wall;

FIG. 31 is a partially cutaway sectional side view of padlock shackles in shackle orifices positioned in extensions from the plug container and the closure wall; and FIG. 32 is a partially cutaway sectional side view of padlock shackles in a shackle orifice of a lock rod.

DESCRIPTION OF PREFERRED EMBODIMENT

Figure 1:
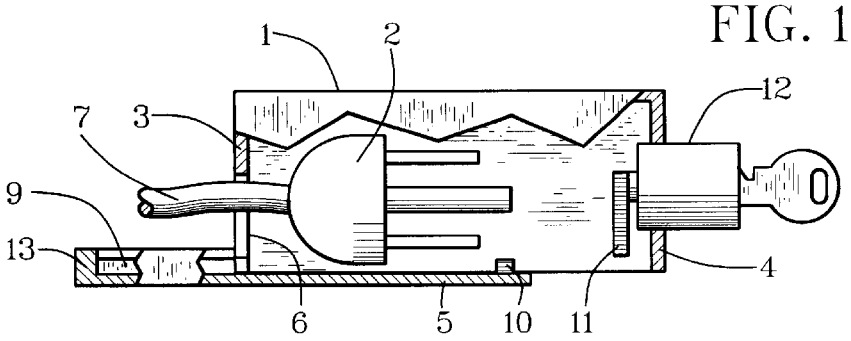
FIG. 1 is a partially cutaway side view with a closure wall that slides from a first end on a slideway with slideway tongues that extend outwardly from oppositely disposed linear edges of a plug container having a designedly rectangular cross section.
Figure 2:
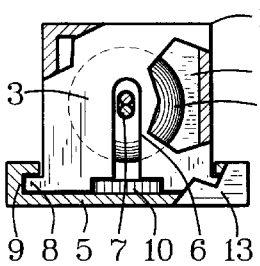
FIG. 2 is a partially cutaway first-end view of the FIG. 1 illustration.
Figure 3:
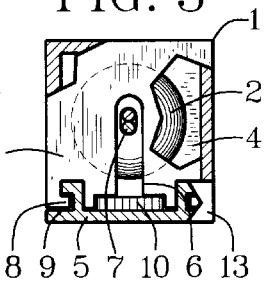
FIG. 3 is a partially cutaway first-end view with a closure wall that slides from a first end on a slideway with slideway tongues that extend inwardly from oppositely disposed linear edges of a plug container having a designedly rectangular cross section.

Reference is made first to FIGS. 1–3. A plug container 1 is sized and shaped to receive an electrical-cord plug 2 laterally. The plug container 1 has a first end 3, a second end 4 and a closure wall 5. The first end 3 has a cord bay 6 that is sized and shaped to receive an electrical cord 7 laterally and to prevent passage of the electrical-cord plug 2 through the cord bay 6.

The closure wall 5 is openable and closeable with a closure positioner such as a container slideway on oppositely disposed linear edges of the plug container 1 and a mating closure slideway on oppositely disposed linear edges of the closure wall 5. The container slideway and the mating closure slideway are tongue-and-grooved for sliding-contact engagement at edges of the closure wall 5 which are in sliding contact with edges of the plug container 1. Slideway tongues 8 are extended outwardly from the oppositely disposed linear edges of the plug container 1 and slideway grooves 9 are extended inwardly from opposite linear edges of the closure wall 5 as depicted in FIGS. 1–2.Optionally as depicted in FIG. 3, the slideway tongues can be extended inwardly from the oppositely disposed linear edges of the plug container 1 and the slideway grooves 9 can be extended outwardly from the opposite linear edges of the closure wall 5.

The electrical-cord plug 2 for which the plug container 1 is sized and shaped to receive is depicted as being a large hemispherical, three-pronged type in order to include the largest type likely to be contained in the plug container 1. The largest anticipated type of electrical cord 7 is shown in FIG. 1 and FIGS. 2–3 the smallest type of electrical cord 7 is shown to indicate design extremities. For limitation of design size of the plug container 1 to small electrical-cord plugs 2 for television sets, the cord bay 6 can be small and short. The plug container 1 and a matching closure wall 5 are preferably three-to-four inches long and one-and-one-half-to-two-inches wide with appropriate height for most design preferences and use conditions. Larger and smaller sizes are foreseeable for particular applications and markets.

FIGS. 1–11 illustrate variations of this electrical-cord lock in which the closure wall 5 is slid off of the plug container 1 from the first end 3 of the plug container 1 to receive the electrical-cord plug 2 and the electrical cord 7 laterally. With the electrical-cord plug 2 in the plug container 1 and with the electrical cord 7 in the cord bay 6, the closure wall 5 is slid to a closed mode at an entrance to the cord bay 6 and at an entrance to the plug container 1.

Figure 10:
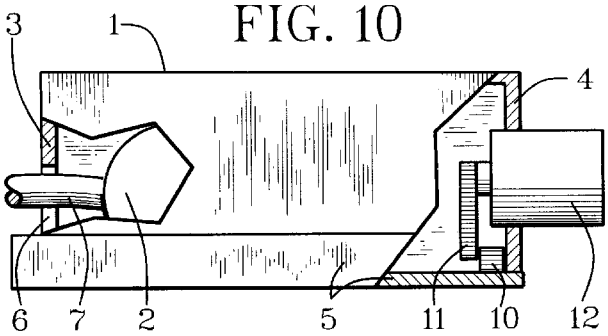
FIG. 10 is a partially cutaway side view of the FIG. 1 illustration in a locked mode.

To achieve the closed mode, a lock abutment 10 or a lock end of the closure wall 5 passes through a relatively wide bottom portion of the cord bay 6. To achieve a locked mode, the closure wall 5 is slid to where the lock abutment 10 is positioned proximate the second end 4 and a latch 11 of a closure lock 12 is positioned on a closure-exit side of the lock abutment 10 as illustrated in FIG. 10. A closure front wall 13 on the closure wall 5 can be employed to close the relatively wide bottom portion of the cord bay 6 in order to prevent escape of particularly thin and small electrical-cord plugs 2 that may be positioned in the plug container 1. Also to prevent escape of thin and small electrical-cord plugs 2, the cord bay 6 can be short and narrow enough to receive only a designedly small electrical cord 7.

FIGS. 2–9 depict four of a variety of foreseeable different shapes of plug container 1. Each shape has optionally outwardly extended slideway tongues 8 or inwardly extended slideways tongues 8.

The plug containers 1 in FIGS. 2–3 have a plurality of two side walls in addition to the closure wall 5, such that each plug container 1 has a designedly rectangular cross section. In FIG. 2 the slideway tongues 8 are extended outwardly and in FIG. 3 the slideway tongues 8 are extended inwardly from opposite-side edges of side walls of the plug container 1. The closure wall 5 is positioned intermediate edges of the two side walls.

Figure 4:
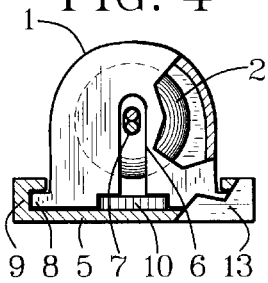
FIG. 4 is a partially cutaway first-end view with a closure wall that slides from a first end on a slideway with slideway tongues that extend outwardly from oppositely disposed linear edges of a plug container having a designedly arcuate cross section.
Figure 5:
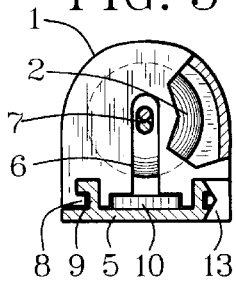
FIG. 5 is a partially cutaway first-end view with a closure wall that slides from a first end on a slideway with slideway tongues that extend inwardly from oppositely disposed linear edges of a plug container having a designedly arcuate cross section.

The plug containers in FIGS. 4–5 have a single arcuate side wall in addition to the closure wall 5, such that each plug container 1 has a designedly arcuate cross section to receive the electrical-cord plug 2. In FIG. 4 the slideway tongues 8 are extended outwardly and in FIG. 5 the slideway tongues 8 are extended inwardly from opposite-side edges of side walls of the plug container 1. The closure wall 5 is positioned intermediate edges of the two side walls.

Figure 6:
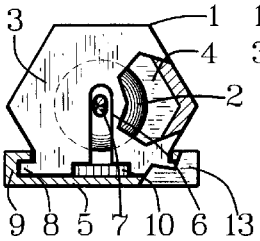
FIG. 6 is a partially cutaway first-end view with a closure wall that slides from a first end on a slideway with slideway tongues that extend outwardly from oppositely disposed linear edges of a plug container having a designedly polygonal cross section.
Figure 7:
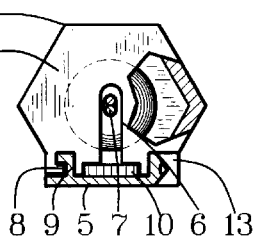
FIG. 7 is a partially cutaway first-end view with a closure wall that slides from a first end on a slideway with slideway tongues that extend inwardly from oppositely disposed linear edges of a plug container having a designedly polygonal cross section.

The plug containers in FIGS. 6–7 have a plurality of more than two side walls in addition to the closure wall 5, such that each plug container 1 has a designedly polygonal cross section to receive the electrical-cord plug 2. In FIG. 6 the slideway tongues 8 are extended outwardly and in FIG. 7 the slideway tongues 8 are extended inwardly from opposite-side edges of side walls of the plug container 1. The closure wall 5 is positioned intermediate edges of the two side walls.

Figure 8:
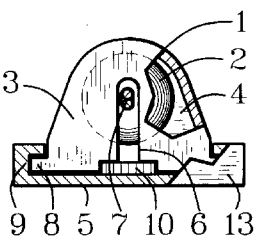
FIG. 8 is a partially cutaway first-end view with a closure wall that slides from a first end on a slideway with slideway tongues that extend outwardly from oppositely disposed linear edges of a plug container having a designedly triangular cross section.
Figure 9:
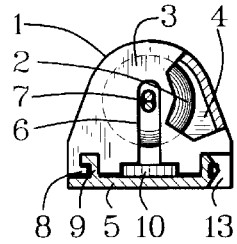
FIG. 9 is a partially cutaway first-end view with a closure wall that slides from a first end on a slideway with slideway tongues that extend inwardly from oppositely disposed linear edges of a plug container having a designedly triangular cross section.

The plug containers in FIGS. 8–9 have a plurality of two side walls in addition to the closure wall 5, such that each plug container 1 has a designedly triangular cross section to receive the electrical-cord plug 2. In FIG. 8 the slideway tongues 8 are extended outwardly and in FIG. 9 the slideway tongues 8 are extended inwardly from opposite-side edges of side walls of the plug container 1. The closure wall 5 is positioned intermediate edges of the two side walls.

Figure 11:
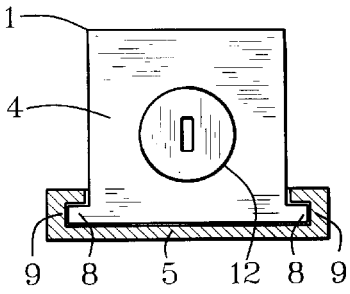
FIG. 11 is a second-end view of the FIG. 10 illustration.
Figure 12:
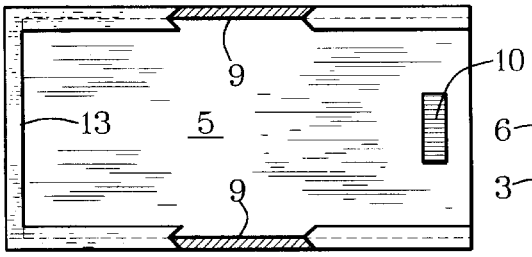
FIG. 12 is a partially cutaway top view of a closure wall that slides from a first end of a plug container on a slideway with slideway tongues that extend outwardly from oppositely disposed linear edges of a plug container having a design cross section.

FIGS. 1 and 10–11 show relationships of either of select design configurations of the plug container 1 to the closure wall 5 and a closure lock 12 on a second end 4 of the plug container 1. In FIG. 1, the closure wall 5 is in a position of traveling either direction between a locked mode shown in FIG. 10 and a removal mode to allow the cord bay 6and the plug container 1 to be open to receive the electrical cord 7 and the electrical-cord plug 2 respectively.

Figure 13:
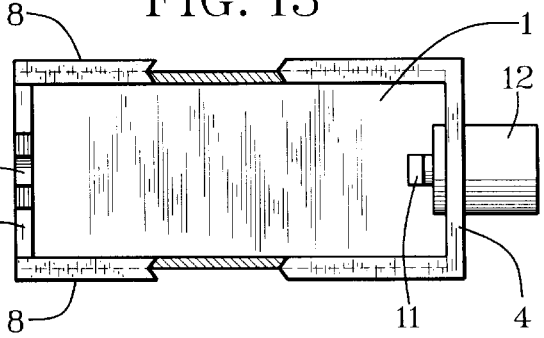
FIG. 13 is a partially cutaway bottom view of a plug container from which the FIG. 12 closure wall slides from a first end and having slideway tongues that extend outwardly from oppositely disposed linear edges of the plug container with a design cross section.
Figure 14:
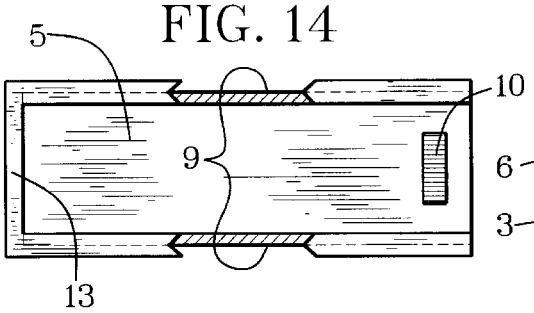
FIG. 14 is a partially cutaway top view of a closure wall that slides from a first end of a plug container on a slideway with slideway tongues that extend inwardly from oppositely disposed linear edges of a plug container having a design cross section.
Figure 15:
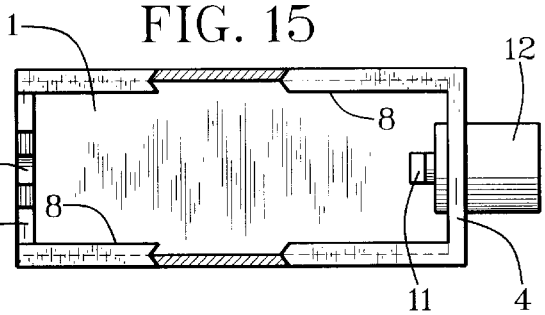
FIG. 15 is a partially cutaway bottom view of a plug container from which the FIG. 14 closure wall slides from a first end and having slideway tongues that extend inwardly from oppositely disposed linear edges of the plug container with a design cross section.
Figure 16:
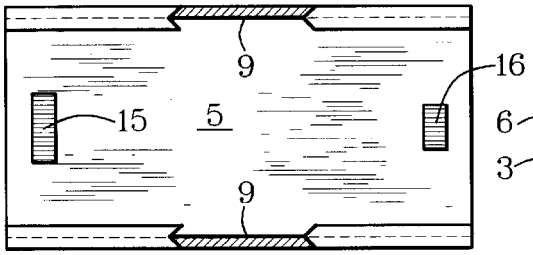
FIG. 16 is a partially cutaway top view of a closure wall that slides from a second end of a plug container on a slideway with slideway tongues that extend outwardly from oppositely disposed linear edges of a plug container having a design cross section.
Figure 17:
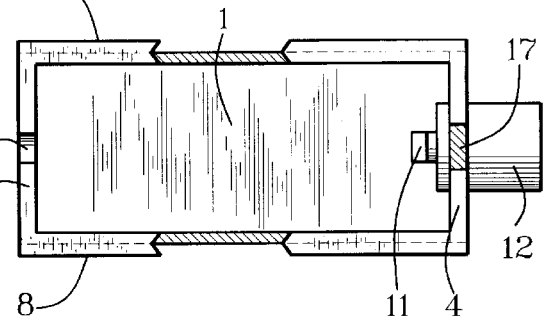
FIG. 17 is a partially cutaway bottom view of a plug container from which the FIG. 16 closure wall slides from a second end and having slideway tongues that extend outwardly from oppositely disposed linear edges of the plug container with a design cross section.
Figure 18:
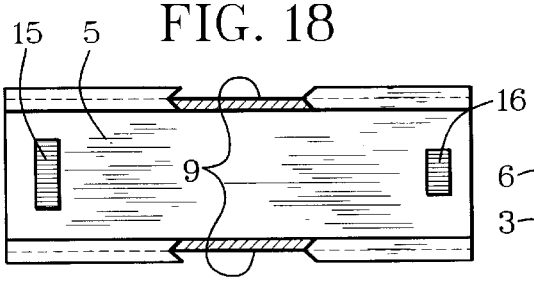
FIG. 18 is a partially cutaway top view of a closure wall that slides from a second end of a plug container on a slideway with slideway tongues that extend inwardly from oppositely disposed linear edges of a plug container having a design cross section.
Figure 19:
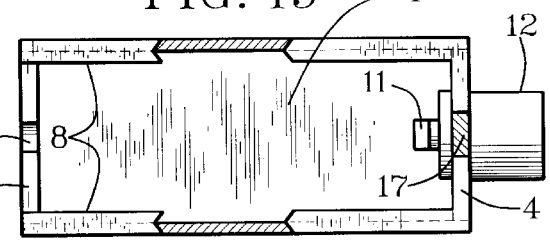
FIG. 19 is a partially cutaway bottom view of a plug container from which the FIG. 18 closure wall slides from a second end and having slideway tongues that extend inwardly from oppositely disposed linear edges of the plug container with a design cross section.

FIGS. 12–15 depict closure walls 5 and plug containers 1 that are separable to position an electrical-cord plug 2 in a plug container 1 and to position an electrical cord 7 in a cord bay 6 respectively. In FIG. 13, slideway tongues 8 are extended outwardly from oppositely disposed linear edges of a plug container 1 and in FIG. 12, slideway grooves 9 are extended inwardly from opposite linear edges of the closure wall 5. In FIG. 15, slideway tongues 8 are extended inwardly from oppositely disposed linear edges of a plug container 1 and in FIG. 14, slideway grooves 9 are extended outwardly from opposite linear edges of the closure wall 5. After the closure wall 5 is separated from the plug container 1 and an electrical-cord plug 2, shown in FIGS. 1–10, has been positioned in the plug container 1 laterally, then the slideway tongues 8 are positioned in the slideway grooves 9 and the closure wall 5 can be slid to where an exit side of the lock abutment 10 can be engaged by the latch 11 of the lock 12.

FIGS. 16–19 depict closure walls 5 and plug containers 1 that do not require separation to position an electrical-cord plug 2 in a plug container 1 and to position an electrical cord 7 in a cord bay 6 respectively. Instead, the closure wall 5 is slid in a direction towards the second end 4 to open the cord bay 6 totally and to open the plug container 1 sufficiently for lateral ingress and egress of the electrical-cord plug 2 and the electrical cord 7. There is n o closure front wall 13 as shown in FIGS. 1–10 and 12–15.

For use without separation of the plug container 1 and the closure wall 5, a container boss 15 is structured and positioned on the closure wall 5 to contact an inside surface of the second end 4 of the plug container 1 to prevent disengagement of the closure wall 5 from the container slideway from the second end 4 of the plug container 1 and to contact an inside surface of the first end 3 of the plug container 1 to prevent disengagement of the closure wall 5 from the container slideway from the first end 3 of the plug container 1. The closure wall 5 can be slid to an open position for allowing lateral entry of an electrical cord 7 in a cord bay 6 and for allowing lateral entry of an electrical-cord plug 2 into the plug container 1 without separation from the plug container 1. Then the closure wall 5 can be slid to a closed position.

The closure wall 5 has a lock boss 16 positioned proximate a second end of the closure wall 5 for engagement with a lock latch 11 in a locked mode. The second end 4 of the plug container 1 has a lock-boss bay 17 that is sized, shaped and positioned to allow ingress and egress of the lock boss 16 but not the container boss 15.

Referring to FIGS. 20–21, the closure wall 5 is slid inwardly and outwardly in relation to the second end 4 for opening and closing the plug container 1 as shown in FIG. 20. The at least one container boss 15 engages inside surfaces of the first end 3 and the second end 4 to prevent separation of the closure wall 5 from the plug container 1. The lock-boss bay 17 allows passage of the lock boss 16 but prevents passage of the container boss 15 through the second end 4. In FIG. 21, the container boss 15 is near the first end 3 and the lock boss 16 is arrested from opening travel by a lock latch 11 in a locked mode.

FIG. 22 is a front view and FIG. 23 is a rear view of a designedly triangular plug container 1 with non-separation of closure walls 5 having slideway grooves 9 extended inwardly. These are representative of other shapes of the plug container 1 having the non-separation feature. A container boss 15 is positioned on opposite sides of the closure wall 15 in order not to be in line with a lock-boss bay 17 through which a lock boss 16 passes through the second end 4.

FIGS. 24–26 are triangular plug containers 1 having inwardly extended slideway tongues 8 which are representative also of other forms of the plug containers 1 having the non-separation feature. A single container boss 15 that is too wide to pass through a lock-boss bay 17 is employed instead of one or more container bosses 15 offset from the lock-boss bay 17 to prevent separation of the plug container 1 and the 5 closure wall 5.

FIGS. 27–29 are representative of tongues 8 and grooves 9 in sliding-contact containment at end edges of the plug container 1. This allows side-to-side travel instead of end-to-end travel of the closure wall 5. The non-separation feature is employed as described in relation to FIGS. 16–29. However, the separation feature described in relation to FIGS. 1–15 can be employed with side-to-side travel also. Also employed with side-to-side travel can be either inwardly or outwardly extended slideway tongues 8 instead of only the outwardly extended slideway tongues shown.

FIGS. 30–32 are representative of means for using padlocks 18 in lieu of various types of locks 12 that are built into a wall such as the second end 4. As depicted in FIG. 30, the closure wall 5 can have a closure shackle orifice 19 and at least one wall of the plug container 1 can have a container shackle orifice 20 into which a padlock shackle 21 of a padlock 18 is inserted for locking mode of either form of the plug container 1.

As depicted in FIG. 31, a container extension 22 can have a container-extension orifice 23 and a closure extension 24 can have a closure-extension orifice 25 for insertion of the padlock shackle 21 of the padlock 18 for locking mode.

Shown in FIG. 32 is a lock rod 26 in an appropriately sized and shaped container shackle orifice 20 and closure shackle orifice 19. Use of a small padlock 18 with a padlock shackle 21 in a lock-rod orifice 27 is allowed by lock features depicted in FIGS. 31–32.

Orifices and extensions for locking with a padlock 18 can be at either end of the electrical-cord lock.

A new and useful electrical-cord lock having been described, all such foreseeable modifications, adaptations, substitutions of equivalents, mathematical possibilities of combinations of parts, pluralities of parts, applications and forms thereof as described by the following claims and not precluded by prior art are included in this invention.

LIST OF NUMBERED COMPONENTS
(For convenience of the Examiner)

| | |
|---|---|
| 1. plug container | 15. container boss |
| 2. electrical-cord plug | 16. lock boss |
| 3. first end | 17. lock-boss bay |
| 4. second end | 18. padlock |
| 5. closure wall | 19. closure shackle orifice |
| 6. cord bay | 20. container shackle orifice |
| 7. electrical cord | 21. padlock shackle |
| 8. slideway tongues | 22. container extension |
| 9. slideway grooves | 23. container-extension orifice |
| 10. lock abutment | 24. closure extension |
| 11. latch | 25. closure-extension orifice |
| 12. closure lock | 26. lock rod |
| 13. closure front wall | 27. lock-rod orifice |
| 14. container boss | |

I claim:

1. An electrical-cord lock comprising:

a plug container that is sized and shaped to receive and completely enclose at all times all elements of an electrical-cord plug on the end of an electrical cord;

the plug container has a first end, and a second end that are closed and a slidable closure wall with slideways on oppositely disposed linear edges of the closure wall;

the first end of the plug container has a cord bay that is sized and shaped to receive the electrical cord laterally and to prevent passage of the electrical-cord plug through the cord bay;

the slidable closure wall is openable and closeable on container slideways which mate with the closure wall slideways that position the closure wall in a bay-closed mode at an entrance to the cord bay and that positions the closure wall in a container-closed mode at an entrance to the plug container; and a closure lock operable by a removable key and is sized, structured and positioned on the electrical-cord lock to lock the closure wall in the bay-closed position at the entrance to the cord bay and to lock the closure wall in a container closed position at the entrance to the plug container, such that the electrical-cord plug can be locked into and unlocked from the plug container by operation of the closure lock.

2. An electrical-cord lock as described in claim 1 wherein:

the plug container has a single side wall in addition to the closure wall;

the single side wall is designedly arcuate to receive the electrical-cord plug; and the closure wall is positioned intermediate opposite linear edges of the single side wall.

3. An electrical-cord lock as described in claim 1 wherein:

the closure positioner has a container slideway on oppositely disposed end edges of the plug container;

the closure positioner has a closure slideway on oppositely disposed end edges of the closure wall; and the container slideway and the closure slideway are tongue-and-grooved for sliding-contact containment at end edges of the closure wall which are in sliding contact with end edges of the plug container.

4. An electrical-cord lock as described in claim 1 wherein:

the plug container has a design plurality of side walls.

5. An electrical-cord look as described in claim 4 wherein:

the closure wall is positioned intermediate edges of two side walls.

6. An electrical-cord lock as described in claim 5 wherein:

the design plurality of side walls is two in addition to the closure wall, such that the plug container has a designedly triangular cross section.

7. An electrical-cord lock as described in claim 5 wherein:

the design plurality of side walls is three in addition to the closure wall, such that the plug container has a designedly rectangular cross section.

8. An electrical-cord lock as described in claim 5 wherein:

the design plurality of side walls is more than three in addition to the closure wall, such that the plug container has a designedly ploygonal cross section.

9. An electrical-cord lock as described in claim wherein:

the container slideway and the mating closure slideway are tongue-and-grooved for sliding contact engagement at edges of the closure wall which are in sliding contact with edges of the plug container.

10. An electrical-cord lock as described in claim 9 wherein:

slideway tongues are extended outwardly from the oppositely disposed linear edges of the plug container; and slideway grooves are extended inwardly from opposite linear edges of the closure wall.

11. An electrical-cord lock as described in claim 9 wherein:

slideway tongues are extended inwardly from the oppositely disposed linear edges of the plug container; and slideway grooves are extended outwardly from opposite linear edges of the closure wall.

12. An electrical-cord lock as described in claim 1 wherein:

the closure lock is positioned proximate the second end of the plug container.

13. An electrical-cord lock as described in claim 12 wherein:

the closure lock has a latch that is positioned against a closure-exit side of a lock abutment on the closure wall in a locked mode.

* * * * *